US005276378A

United States Patent [19]

Gothard

[11] Patent Number: 5,276,378

[45] Date of Patent: Jan. 4, 1994

[54] FLUORESCENT LIGHT EMITTING DEVICE

[75] Inventor: David L. Gothard, San Jose, Calif.

[73] Assignee: Neonix, Inc., Campbell, Calif.

[21] Appl. No.: 818,618

[22] Filed: Jan. 10, 1992

[51] Int. Cl.[5] ..... H01J 17/16; H01J 61/06

[52] U.S. Cl. ..... 313/491; 313/493; 315/248

[58] Field of Search ..... 313/491, 492, 493, 486; 315/248, 344

[56] References Cited

U.S. PATENT DOCUMENTS

| | | | |
|---|---|---|---|
| 2,965,785 | 12/1960 | Ropp et al. | 313/486 |
| 3,253,176 | 5/1966 | Pate et al. | 313/493 X |
| 4,584,501 | 4/1986 | Cocks et al. | 313/493 |
| 4,798,997 | 1/1989 | Egami et al. | 315/248 X |

*Primary Examiner*—Sandra L. O'Shea

*Attorney, Agent, or Firm*—Claude A. S. Hamrick

[57] ABSTRACT

This invention provides for a light emitting device which comprises an envelope of electrically insulative material which defines within its boundaries an ionization chamber. A noble gas is disposed within the chamber and two spaced electrodes are located on the light emitting device such that the electrodes are in electrical communication with the interior of the chamber. At least one conductive member is disposed on the device and arranged to define a tortuous path between the two electrodes but without providing a direct electrical connection between the two electrodes. When a high frequency alternating voltage is applied to the electrodes the electrical interaction between the electrodes and the conductive member causes an ionization path between the electrodes to substantially follow the tortuous path.

20 Claims, 2 Drawing Sheets

FLUORESCENT LIGHT EMITTING DEVICE

BACKGROUND OF THE INVENTION

1. Field of the Invention

This invention relates to fluorescent light emitting devices and more particularly to such devices in which the ionized, light emitting gas follows a non-direct, non-linear path.

2. Brief Description of the Prior Art

Fluorescent lighting in the form of gas discharge tubes containing ionizable gas is well known. This lighting form works as follows: an elongate tube with an electrode at each end is filled with an ionizable gas. When a power source is connected across the electrodes ionization of the gas occurs causing the gas to glow and emit light.

In what is commonly called "cold cathode" lighting apparatus, a high voltage is applied across the two electrodes; this voltage being sufficiently high to cause ionization of the gas directly. As opposed to this, "hot cathode" lamps operate by imparting heat energy to the gas at each electrode; this heat energy being sufficient to cause localized ionization of the gas at the electrode. Thereafter, a much lower voltage, as compared to that used in cold cathode lamps, is applied across the electrodes to maintain ionization of the remainder of the gas volume.

It is usual for the interior surface of the gas discharge tube to be coated with a fluorescent material such as phosphorous which fluoresces as a result of the glowing ionized gas. It is this layer of phosphorous that emits the commonly known fluorescent light and has the effect of making the expanse of light corresponding to the band of ionization more uniform and spread out than the ionization band itself. Typically gas discharge tubes contain a noble gas such as neon or argon.

The relative advantages of gas discharge lighting devices are well known and include: low heat generation, lower energy costs for a given intensity of lighting and long bulb life.

It is a characteristic of gas discharge lamps that the path of ionization follows the shortest route between the two electrodes. Even with the dispersion effect caused by the fluorescent lining on the inside of the tubes, the lighting effect of gas discharge tubes is at best in the form of a narrow band of light.

The disadvantage of this characteristic is that the use of gas discharge lighting devices in situations where a non-linear or non-direct light path is required, needs special engineering. An example of this is in the decorative or sign writing applications where the tube, in which the gas is contained, must be bent or shaped into the desired configuration.

Alternatively, as has been proposed in U.S. Pat. No. 4,584,501 (Cocks et al.), a configured or shaped ionization chamber can be carved into thick glass plates.

Both these methods of shaping the ionization path of the gas are in fact methods of configuring or shaping the ionization chamber such that the ionization path is forced to follow a path dictated by the shape of the chamber. Both these methods have the disadvantage that they are expensive to implement.

In addition there are other instances where a uniform sheet of lighting is required. An example of this is the office environment where a plurality of fluorescent lighting tubes are used in combination with reflectors and/or light diffusers to produce an approximation of a sheet of light. Although such systems are adequate it would be better and less complicated if the combination were to be replaced by a single sheet light element which produces a uniform sheet of lighting.

SUMMARY OF THE INVENTION

Object of the Invention

It is therefore an object of this invention to provide a lighting device of the gas discharge type wherein the path followed by the band of ionized gas associated with gas discharge lighting device, is of a predetermined, non-direct configuration.

It is a further object of this invention to provide a gas discharge lamp capable of emitting an expansive sheet of light.

It is yet another object of this invention to provide a single envelope containing an ionizable gas which, using only two electrodes, can be used to provide a substantially uniform sheet of light.

Summary of Invention

This invention provides for a light emitting device which comprises an envelope of electrically insulative material which defines within its boundaries an ionization chamber. A noble gas is disposed within the chamber and two spaced electrodes are located on the light emitting device such that the electrodes are in electrical communication with the interior of the chamber. At least one conductive member is disposed on the device and arranged to define a tortuous path between the two electrodes but without providing a direct electrical connection between the two electrodes. When an alternating voltage is applied across the electrodes the electrical interaction between the electrodes and the conductive member causes an ionization path between the electrodes to substantially follow the tortuous path.

DETAILED DESCRIPTION OF THE PREFERRED EMBODIMENTS

Figure 1:
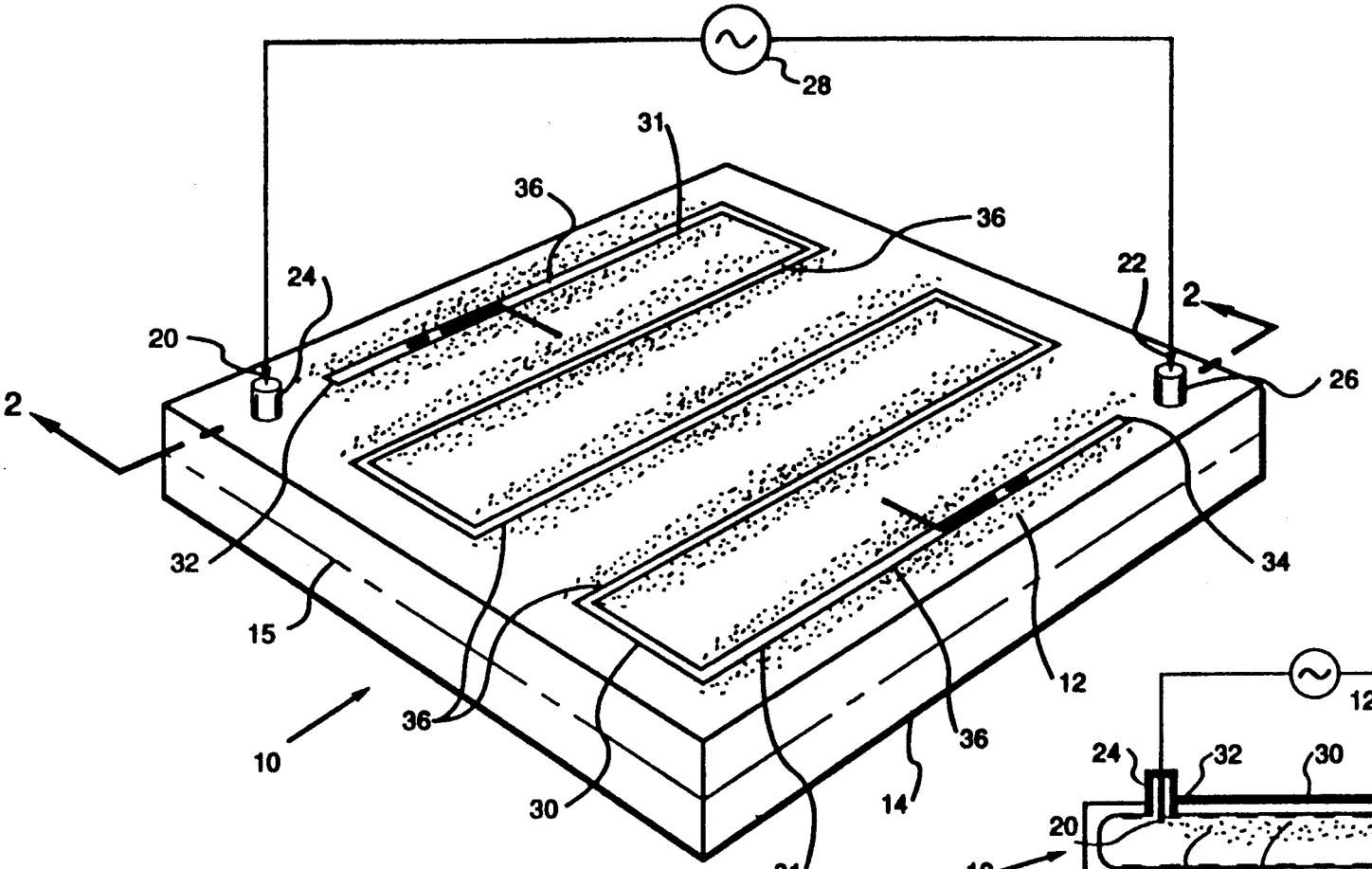
FIG. 1 is a pictorial representation of a light emitting device in accordance with the invention.
Figure 2:
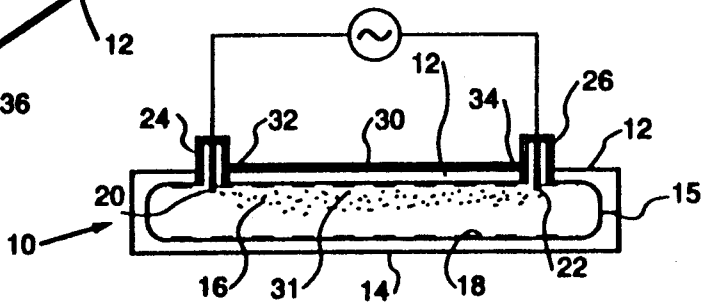
FIG. 2 is a section taken along line 2—2 in FIG. 1.

A first application of the principle of this invention is illustrated in both FIGS. 1 and 2 where a light emitting device, generally indicated as 10, is shown to be constituted by two flat glass sheets 12, 14 with downturned-/upturned edges sealingly joined at 15 so as to define between them a sealed ionization chamber 16. In the preferred embodiment the separation between the plates 12,14 is approximately 0.25 inches (6.35 mm).

The inner surface of each of the glass plates 12, 14 is preferably coated with a layer of fluorescent material 18 such as phosphorous. The ionization chamber 16 is filled with a noble gas such as argon or neon.

At diagonally opposite corners of the upper glass plate 12, two electrodes 20, 22 are located. Each of these electrodes is mounted in an electrode holder 24, 26 which opens into the chamber 16 at one end thereof and is sealed at the other end so as to maintain the sealed integrity of the interior of the chamber 16. As is apparent from FIG. 2 the electrodes 20, 22 are in direct electrical communication with the interior of the chamber 16 and the gas contained therein. These electrodes are connected to a high voltage AC voltage source 28 which in one embodiment produces an AC voltage of a frequency in excess of 20 kiloHertz (kHz).

On the outside of the upper plate 12 a metal conductive strip 30 is arranged to define a tortuous, serpentine path between the two electrodes 20, 24. The respective ends 32, 34 of the strip 30 are spaced from the electrodes 20, 22 and do not make electrical connection with them.

If the conductive strip 30 was not associated with the device 10 and an AC voltage from the voltage source 28 were applied across the electrodes 20, 22 ionization of the gas within the chamber 16 would occur. However, this ionization would be along a path which represents the shortest route between the electrodes 20, 22. In the configuration as shown this path would be along the diagonal between the two electrodes.

It has, however, been found that with the conductive strip 30 arranged on the glass sheet 12, as illustrated, that the path of ionization of the gas follows the serpentine path defined by the strip 30. As a result, a serpentine band of ionization 31 which follows the path of the conductive strip 30, is produced between the two electrodes instead of a diagonally orientated band of ionization.

As has been previously indicated, the effect of the fluorescent layer 18 on the inside of the glass plates is to make the light emitted by the band of ionization appear to be more uniform. This layer also has the effect of widening the expanse of light emitted by the device. In order to achieve a substantially uniform sheet of fluorescent light from the lighting device it has been found that the longer legs 36 of the conductive strip 30 must be spaced relatively close to one another so that the corresponding expanses of fluorescently generated light overlap at their edges. It has been found that a spacing between the legs of approximately 50 mm is appropriate to make the illuminating expanses overlap. This distance will, however, among other factors, be dependent on the magnitude and the frequency of the voltage applied the electrodes 20, 22.

It is believed that the conductive strip acts together with the electrodes to form a distributed capacitance and associated electric field along the path followed by the strip 30 which favorably influences the ionization path through the chamber 16.

In practice, the lighting device would normally be configured so that useful light is emitted from the lower surface 14 and some type of reflective means be disposed at or on the upper surface 12 so as to improve the efficiency of the light source.

Figure 3:
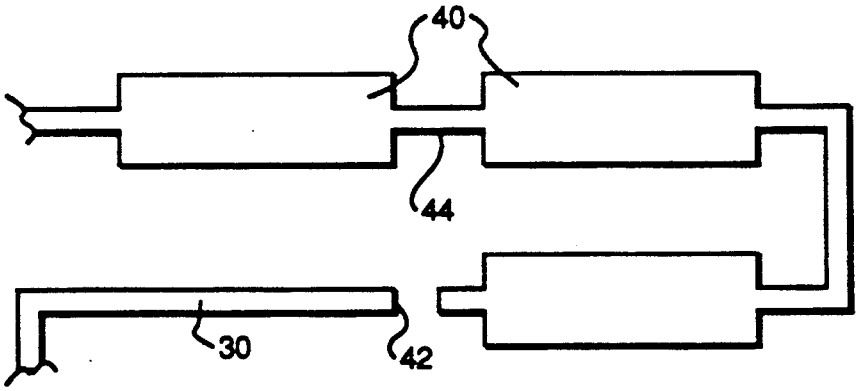
FIG. 3 is a schematic illustration of one possible configuration of a conductive member used on the device of the invention.

Although a continuous conductive strip 30 is shown, it is anticipated that a discontinuous strip or strip having non-uniform width, thickness or conductivity may also be useful. This is illustrated in FIG. 3 where the conductive strip 30 is shown to include a number of enlarged segments 40 and a discontinuity at 42. The enlarged segments can be used as areas where an electrical charge "concentrates" causing greater ionization of the gas to occur around these segments. This effect would be enhanced if the portions 44 of the strip, between these segments 40, were particularly thin when compared to the expanses of the segments 40. This kind of configuration could be useful in instances where, for decorative or other purposes, concentrations of light in certain areas is required.

In addition, it will be apparent that the principles of this invention need not necessarily be used only with flat plates of glass but may be used with any lighting surface. For example, the plates could be curved, dome shaped, corrugated or of any other suitable form.

Moreover, the principle of this invention where the path followed by the band of ionized gas is controlled to be a predetermined, non-direct path, can be applied to situations other than where a uniform sheet of lighting is required. This principle can, for example, be used in sign writing or other decorative lighting applications.

Figure 4:
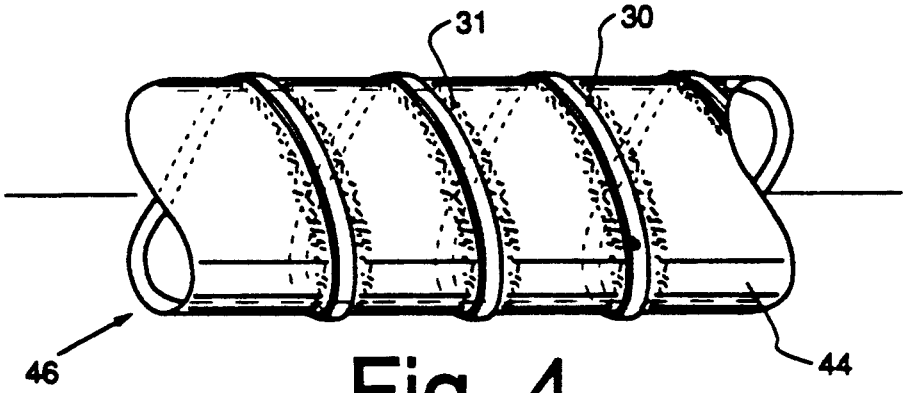
FIG. 4 is a portion of a tube illustrating a different use of the principle of this invention.

An example of this is the tube 44 illustrated in FIG. 4. In this embodiment the conductive member 30 spirals around the surface of the tube. When an appropriate voltage is applied across the electrodes (not shown) the band of ionization 31 would follow the member 30 giving the tube the effect of a decorative lighting emitting device in the form of a spiral of light. As is apparent from this FIGURE, this effect is achieved without the use of expensive-to-manufacture, spirally bent tubes.

Figure 5:
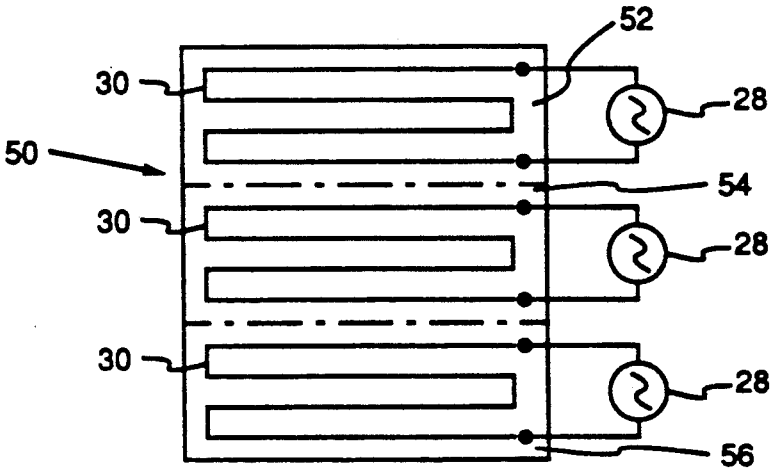
FIG. 5 is a schematic representation of yet another embodiment of the invention.

A further example of how the light panel of FIG. 1 can be used is illustrated in FIG. 5. Here the panel 50 is divided into three different sections 52, 54 and 56. Each section includes its own conductive member 30 with electrodes and alternating voltage source 28 associated therewith and each may be individually energized to produce light at different times or for different time intervals.

This effect could, of course, be achieved by the use of a single panel with a single conductive member and electrodes associated therewith, where such a panel is used in conjunction with three shutters, in the form of say LCD light filters, which are sequentially operated.

It is further possible to use different combinations of differently colored light filters to achieve a lighting device giving variable and controllable lighting effects.

Similarly and although a "cold cathode" configuration is described and depicted, it is anticipated that a "hot cathode" embodiment could likewise be useful.

While the invention has been particularly shown and described with reference to certain preferred embodiments, it will be understood by those skilled in the art that various alterations and modifications in form and in detail may be made therein. Accordingly, it is intended that the following claims cover all such alterations and modifications as may fall within the true spirit and scope of the invention.

What is claimed is:

1. A lighting device for actuation by a high frequency power supply comprising:

two spaced apart sheets of electrically insulative material joined at the edges thereof to define an envelope forming a sealed ionization chamber;

a noble gas disposed within the chamber;

at least two spaced apart electrodes located on the envelope with each being in communication with the interior of the chamber; and at least one conductive member disposed on said envelope outside said chamber and arranged to define a predetermined path other than a straight line between the two electrodes, the conductive member being electrically isolated from at least one of the electrodes, whereby when an actuating voltage of at least 20,000 Hz is applied across the electrodes, the electrical interaction between the electrodes and the conductive member causes an ionization path between the electrodes to substantially follow the predetermined path defined by said conductive member.

2. A lighting device according to claim 1 wherein the predetermined path is tortuous and of a length substantially longer than the direct distance between the electrodes.

3. A lighting device according to claim 2 wherein the interior surfaces of the sheets are coated with a fluorescent material.

4. A lighting device according to claim 3 wherein the fluorescent material is phosphorous.

5. A lighting device according to claim 1 wherein the sheets comprise glass or similar vitreous material.

6. A lighting device according to claim 5 wherein the sheets are flat plates.

7. A lighting device according to claim 1 wherein the member is non-continuous along the predetermined path.

8. A lighting device according to claim 6 wherein the predetermined path is serpentine and configured so that adjacent bands of light resulting from the ionization path complement one another so as to present a substantially uniform sheet of light.

9. A lighting device according to claim 8 wherein the member is disposed on the lighting device.

10. A lighting device according to claim 8 wherein the gas is one of argon or neon.

11. A lighting device according to claim 1 which is configured to be operable by an alternating voltage source of a frequency greater than or equal to 20 kH.

12. A light emitting device for actuation by a high frequency power supply comprising:

an envelope of electrically insulative material defining within its boundaries a sealed ionization chamber;

a noble gas disposed within the chamber;

at least two spaced apart electrodes located on the envelope with each being in communication with the interior of the chamber; and at least one conductive member disposed on a surface of said envelope outside said chamber and arranged to define a predetermined path other than a straight line between the two electrodes, the conductive member being electrically isolated from at least one of the electrodes, whereby when an oscillatory voltage of at least 20,000 Hz is applied across the electrodes, the electrical interaction between the electrodes and the conductive member causes an ionization path between the electrodes to substantially follow the predetermined path defined by said conductive member.

13. A light emitting device according to claim 12 wherein the predetermined path is of a length substantially longer than the direct distance between the electrodes.

14. A light emitting device according to claim 13 wherein the interior surfaces of the envelopes are at least partially coated with a fluorescent material.

15. A light emitting device according to claim 14 wherein the fluorescent material is phosphorous.

16. A light emitting device according to claim 12 wherein the envelope comprise glass or similar vitreous material.

17. A light emitting device according to claim 12 wherein the member is non-continuous along the predetermined path.

18. A method of controlling the pattern of light emitted by a light emitting device actuatable by a high frequency power supply, comprising:

providing an envelope of electrically insulative material which defines within its boundaries a sealed ionization chamber;

causing a noble gas to be disposed within the chamber;

causing at least two spaced apart electrodes to be located on the envelope with each being in communication with the interior of the chamber;

providing at least one conductive member on a surface of said envelope outside of said chamber, said member being arranged to define a predetermined path other than a straight line between the spaced apart electrodes and being electrically isolated from at least one of the electrodes; and applying an oscillator voltage of at least 20,000 Hz across the electrodes such that the electrical interaction between the electrodes and the conductive member causes an ionization path between the electrodes to substantially follow the predetermined path defined by said conductive member.

19. The method according to claim 18 wherein the predetermined path is of a length substantially longer than the direct distance between the electrodes.

20. A lighting device according to claim 18 wherein the member is non-uniform along the predetermined path.

* * * * *